US010673158B2

(12) United States Patent
Aoki et al.

(10) Patent No.: US 10,673,158 B2
(45) Date of Patent: Jun. 2, 2020

(54) CONNECTOR ASSEMBLY

(71) Applicant: JAPAN AVIATION ELECTRONICS INDUSTRY, LIMITED, Tokyo (JP)

(72) Inventors: Shigeharu Aoki, Tokyo (JP); Akira Kimura, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 16/438,771

(22) Filed: Jun. 12, 2019

(65) Prior Publication Data

US 2020/0052424 A1 Feb. 13, 2020

(30) Foreign Application Priority Data

Aug. 7, 2018 (JP) ..... 2018-148673

(51) Int. Cl.
*H01R 12/71* (2011.01)
*H01R 12/73* (2011.01)
(Continued)

(52) U.S. Cl.
CPC ..... *H01R 12/716* (2013.01); *H01R 12/73* (2013.01); *H01R 12/91* (2013.01); *H01R 13/11* (2013.01);
(Continued)

(58) Field of Classification Search
CPC ..... H01R 12/52; H01R 12/716; H01R 12/91; H01R 12/73; H01R 13/6315; H01R 13/11; H01R 13/26; H01R 13/642
(Continued)

(56) References Cited

U.S. PATENT DOCUMENTS 5,201,663 A * 4/1993 Kikuchi ..... H01R 13/6315 439/83
7,510,445 B2 3/2009 Tokunaga
(Continued)

FOREIGN PATENT DOCUMENTS

JP H04-269478 A 9/1992
JP H07-161415 A 6/1995
(Continued)

OTHER PUBLICATIONS

Extended European Search Report dated Dec. 9, 2019 in European Application No. 19182495.2.

*Primary Examiner* — Hien D Vu
(74) *Attorney, Agent, or Firm* — Collard & Roe, P.C.

(57) ABSTRACT

A connector assembly comprises a first connector having a first contact and a second connector having a second contact. The first contact has a first supported portion which is supported not to be moved in a horizontal direction, a first resiliently-support portion extending from the first supported portion and a first contact point supported by the first resiliently-support portion. The second contact has a second supported portion which is supported not to be moved in the horizontal direction, a second resiliently-support portion extending from the second supported portion and a second contact point supported by the second resiliently-support portion. Under a completely-mated state where the first connector and the second connector are completely mated with each other, the first contact point is in contact with the second supported portion, and the second contact point is in contact with the first supported portion.

7 Claims, 11 Drawing Sheets

(51) Int. Cl.

| | |
|---|---|
| ***H01R 12/91*** | (2011.01) |
| ***H01R 13/11*** | (2006.01) |
| ***H01R 13/26*** | (2006.01) |
| ***H01R 13/28*** | (2006.01) |
| ***H01R 13/642*** | (2006.01) |

(52) U.S. Cl.
CPC ..... *H01R 13/26* (2013.01); *H01R 13/28* (2013.01); *H01R 13/642* (2013.01)

(58) Field of Classification Search
USPC ..... 439/74
See application file for complete search history.

(56) References Cited

U.S. PATENT DOCUMENTS

| | | | | |
|---|---|---|---|---|
| 8,152,548 | B2 * | 4/2012 | Masuda | H01R 12/73 439/291 |
| 8,257,095 | B2 * | 9/2012 | Akai | H01R 13/6315 439/74 |
| 9,252,517 | B2 * | 2/2016 | Kimura | H01R 12/85 |
| 2005/0142922 | A1 | 6/2005 | Akasaka et al. | |
| 2014/0213115 | A1 | 7/2014 | Kimura | |

FOREIGN PATENT DOCUMENTS

| | | | |
|---|---|---|---|
| JP | H10-284197 | A | 10/1998 |
| JP | 2005-190815 | A | 7/2005 |
| JP | 4190019 | B2 | 12/2008 |
| JP | 2010-272320 | A | 12/2010 |
| JP | 2015-095450 | A | 5/2015 |
| JP | 6002031 | B2 | 10/2016 |

* cited by examiner

CONNECTOR ASSEMBLY

CROSS REFERENCE TO RELATED APPLICATIONS

This application is based on and claims priority under 35 U.S.C. § 119 to Japanese Patent Application No. JP2018-148673 filed Aug. 7, 2018, the content of which is incorporated herein in its entirety by reference.

BACKGROUND OF THE INVENTION

This invention relates to a connector assembly comprising two connectors mateable with each other.

For example, this type of connector assembly is disclosed in JP4190019B (Patent Document 1), the content of which is incorporated herein by reference.

Referring to FIG. 17, Patent Document 1 discloses a connector assembly 90 comprising a receptacle connector (first connector) 92 and a plug connector (second connector) 96 mateable with each other. The first connector 92 comprises a housing 920 and a receptacle contact (first contact) 930 held by the housing 920. The first contact 930 has a contact portion 932 and a contact-catching portion 934. The second connector 96 comprises a housing 960 and a plug contact (second contact) 970 held by the housing 960. The second contact 970 has a contact portion 972 and a contact-catching portion 974.

Referring to FIG. 18, when an end of the second connector 96 is deeply inserted into the first connector 92, the first connector 92 and the second connector 96 are mated with each other. Under this deeply-mated state, the contact portion 932 of the first contact 930 is brought into contact with the contact-catching portion 974 of the second contact 970, and the contact portion 972 of the second contact 970 is brought into contact with the contact-catching portion 934 of the first contact 930. As a result, the first connector 92 and the second connector 96 are electrically connected with each other.

Referring to FIG. 17, for example, the first connector 92 and the second connector 96 are mounted on two circuit boards (not shown), respectively, and are used to electrically connect the two circuit boards with each other. These two circuit boards are often installed in an electronic device (not shown). In this case, the end of the second connector 96 sometimes cannot be deeply inserted into the first connector 92 because of some reasons such as structural restriction of the electronic device. In other words, the first connector 92 and the second connector 96 are sometimes shallowly mated with each other. Referring to the contact portion 932 and the contact portion 972 illustrated in dashed line in FIG. 17, under the shallowly-mated state, the contact portion 932 and the contact portion 972 might be unable to be moved to the contact-catching portion 974 and the contact-catching portion 934, respectively. As a result, the electrical connection between the first connector 92 and the second connector 96 might not be made or might be unstably.

SUMMARY OF THE INVENTION

It is therefore an object of the present invention to provide a mechanism which enables electrical, secure connection between a first connector and a second connector even when the first connector and the second connector are shallowly mated with each other.

An aspect of the present invention provides a connector assembly comprising a first connector and a second connector. The second connector is mateable with the first connector which is located below the second connector in an upper-lower direction. The first connector comprises a first housing and a first contact. The first housing has a first support portion and is formed with a first receiving portion and a first movement-allowing portion. The first receiving portion receives, at least in part, the second connector when the first connector and the second connector are mated with each other. The first support portion is located adjacent to the first receiving portion in a horizontal direction perpendicular to the upper-lower direction. The first movement-allowing portion is located above the first support portion and is located adjacent to the first receiving portion in the horizontal direction. The first contact has a first supported portion, a first resiliently-support portion and a first contact point. The first supported portion extends in the upper-lower direction along a boundary between the first support portion and the first receiving portion and is supported by the first support portion not to be moved in the horizontal direction. The first resiliently-support portion extends from the first supported portion while being apart from the first support portion in the horizontal direction. The first contact point is supported by the first resiliently-support portion. Under a separated state where the first connector and the second connector are separated from each other, the first contact point is located in the first receiving portion and is apart from the first support portion in each of the upper-lower direction and the horizontal direction, and the first movement-allowing portion allows the first contact point to be moved in the horizontal direction in accordance with resilient deformation of the first resiliently-support portion. The second connector comprises a second housing and a second contact. The second housing has a second support portion and is formed with a second receiving portion and a second movement-allowing portion. The second receiving portion receives, at least in part, the first connector when the first connector and the second connector are mated with each other. The second support portion is located adjacent to the second receiving portion in the horizontal direction. The second movement-allowing portion is located below the second support portion and is located adjacent to the second receiving portion in the horizontal direction. The second contact has a second supported portion, a second resiliently-support portion and a second contact point. The second supported portion extends in the upper-lower direction along a boundary between the second support portion and the second receiving portion and is supported by the second support portion not to be moved in the horizontal direction. The second resiliently-support portion extends from the second supported portion while being apart from the second support portion in the horizontal direction. The second contact point is supported by the second resiliently-support portion. Under the separated state, the second contact point is located in the second receiving portion and is apart from the second support portion in each of the upper-lower direction and the horizontal direction, and the second movement-allowing portion allows the second contact point to be moved in the horizontal direction in accordance with resilient deformation of the second resiliently-support portion. Under a completely-mated state where the first connector and the second connector are completely mated with each other, the first contact point is in contact with the second supported portion, and the second contact point is in contact with the first supported portion. Under the completely-mated state, the first resiliently-support portion is not in contact with the first housing, and the second resiliently-support portion is not in contact with the second housing.

The connector assembly according to an aspect of the present invention comprises the first connector and the second connector mateable with each other. Under the completely-mated state (deeply-mated state) according to an aspect of the present invention, the first contact point of the first contact is in contact with the second supported portion of the second contact, and the second contact point of the second contact is in contact with the first supported portion of the first contact. Since the first supported portion and the second supported portion are supported by the first support portion and the second support portion, respectively, so as not to be moved in the horizontal direction, the first contact point and the second contact point are securely in contact with the second supported portion and the first supported portion, respectively, with sufficient contact pressure.

Moreover, according to an aspect of the present invention, the first resiliently-support portion of the first contact extends from the first supported portion while being apart from the first support portion in the horizontal direction, and the second resiliently-support portion of the second contact extends from the second supported portion while being apart from the second support portion in the horizontal direction. According to this structure, under a shallowly-mated state, the first contact point supported by the first resiliently-support portion is brought into contact with the second resiliently-support portion, and the second contact point supported by the second resiliently-support portion is brought into contact with the first resiliently-support portion. Meanwhile, each of the first resiliently-support portion and the second resiliently-support portion is resiliently deformed, so that the first contact point and the second contact point are securely in contact with the second resiliently-support portion and the first resiliently-support portion, respectively, with sufficient contact pressure. Thus, an aspect of the present invention provides a mechanism which enables electrical, secure connection between the first connector and the second connector even when the first connector and the second connector are shallowly mated with each other.

An appreciation of the objectives of the present invention and a more complete understanding of its structure may be had by studying the following description of the preferred embodiment and by referring to the accompanying drawings.

Figure 1:
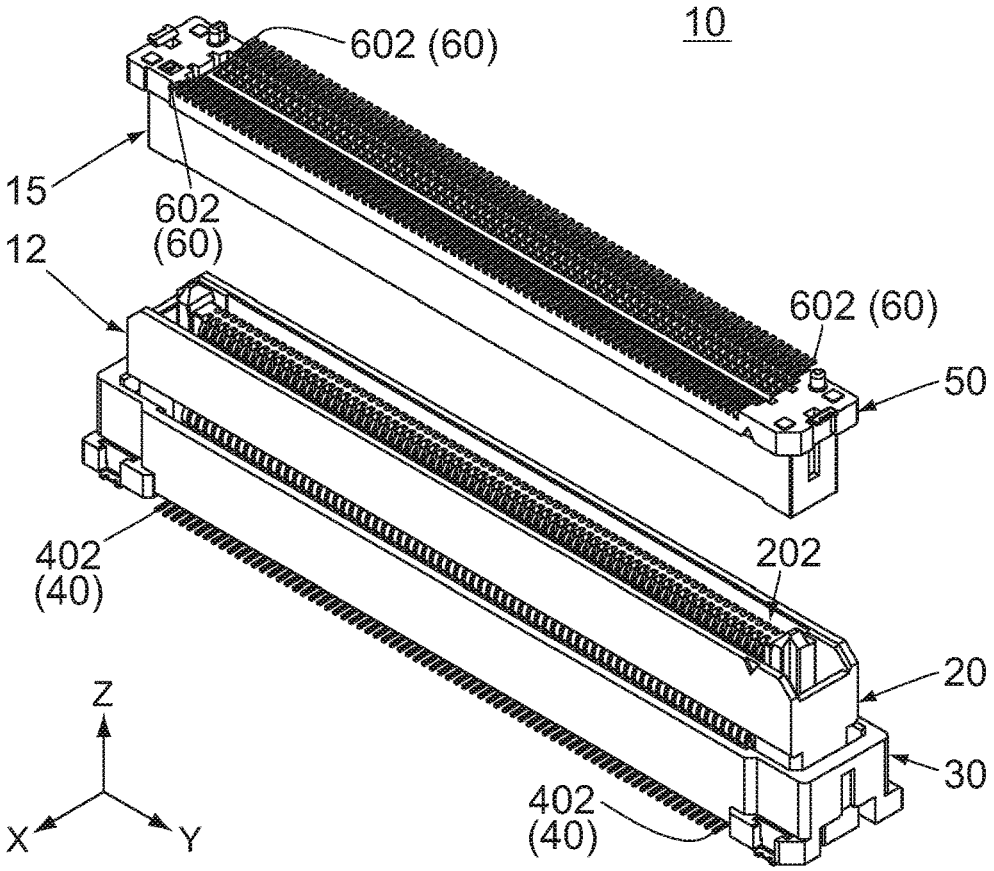
FIG. 1 is a perspective view showing a connector assembly according to an embodiment of the present invention, wherein a first connector and a second connector of the connector assembly are separated from each other.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

As shown in FIGS. 1 to 4, a connector assembly 10 according to an embodiment of the present invention comprises a first connector 12 and a second connector 15. Along an upper-lower direction (Z-direction), the second connector 15 is mateable with the first connector 12 which is located below the second connector 15 in the Z-direction, or located at a position which the negative Z-side of the second connector 15 faces in the Z-direction. The second connector 15 mated with the first connector 12 can be removed from the first connector 12 along the Z-direction.

Figure 2:
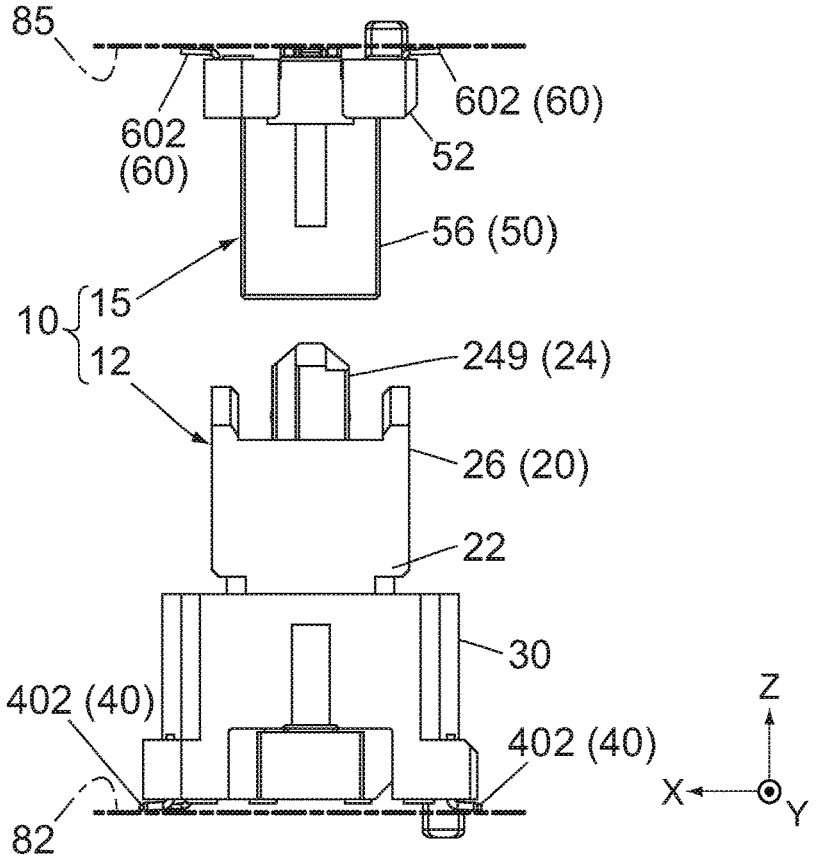
FIG. 2 is a side view showing the connector assembly of FIG. 1, wherein chain dotted lines illustrate a part of a first circuit board on which the first connector is mounted and a part of a second circuit board on which the second connector is mounted.
Figure 3:
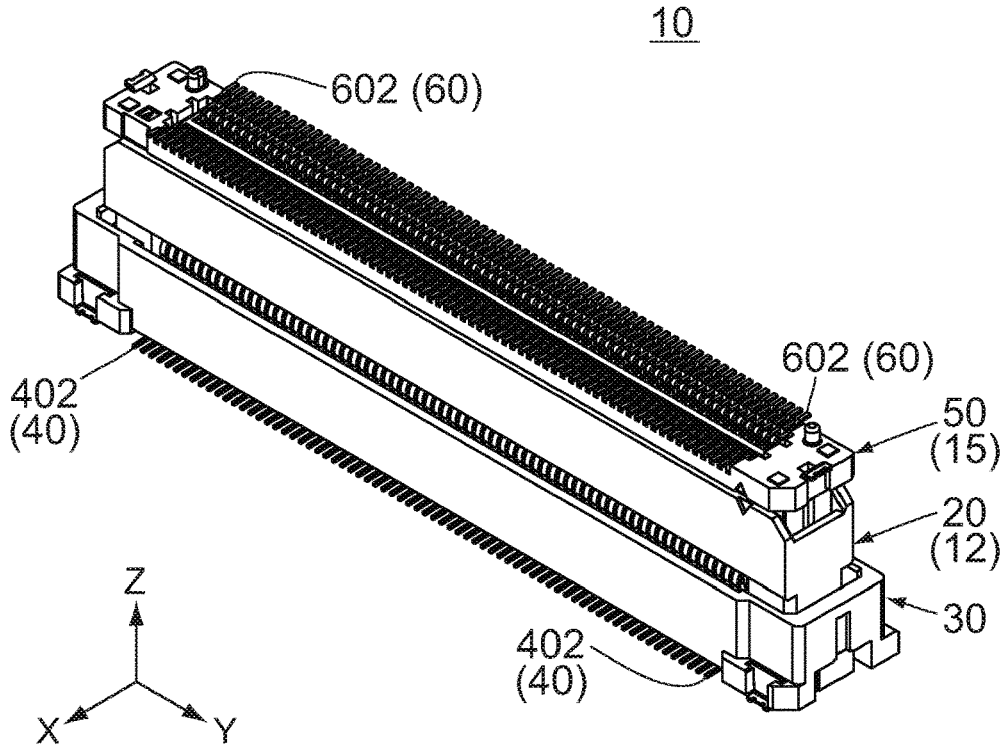
FIG. 3 is a perspective view showing the connector assembly of FIG. 1, wherein the first connector and the second connector are deeply mated with each other.
Figure 4:
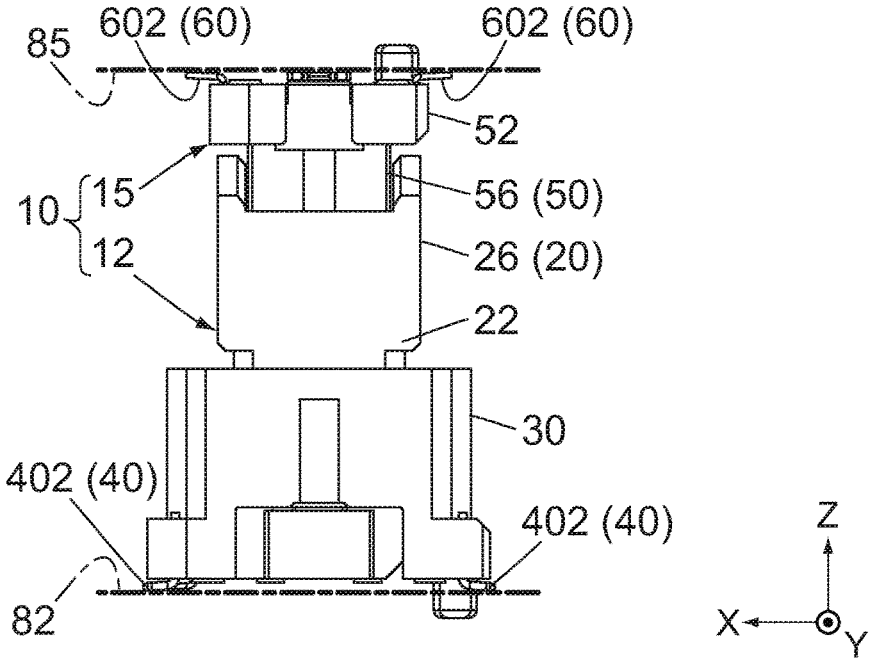
FIG. 4 is a side view showing the connector assembly of FIG. 3, wherein chain dotted lines illustrate a part of the first circuit board and a part of the second circuit board.

Referring to FIGS. 2 and 4, in the present embodiment, the first connector 12 is an on-board connector which is to be mounted on a first circuit board 82, and the second connector 15 is another on-board connector which is to be mounted on a second circuit board 85. Moreover, the first connector 12 is a plug, and the second connector 15 is a receptacle. In particular, the first connector 12 is a floating connector. However, the present invention is not limited thereto but is applicable to connector assemblies with various types of first connectors and second connectors. For example, the first connector 12 may be a receptacle, and the second connector 15 may be a plug. Each of the first connector 12 and the second connector 15 may be a floating connector or may not be a floating connector. Thus, one of the first connector 12 and the second connector 15 may be a floating connector.

Hereafter, explanation will be made about a structure of the first connector 12.

Figure 5:
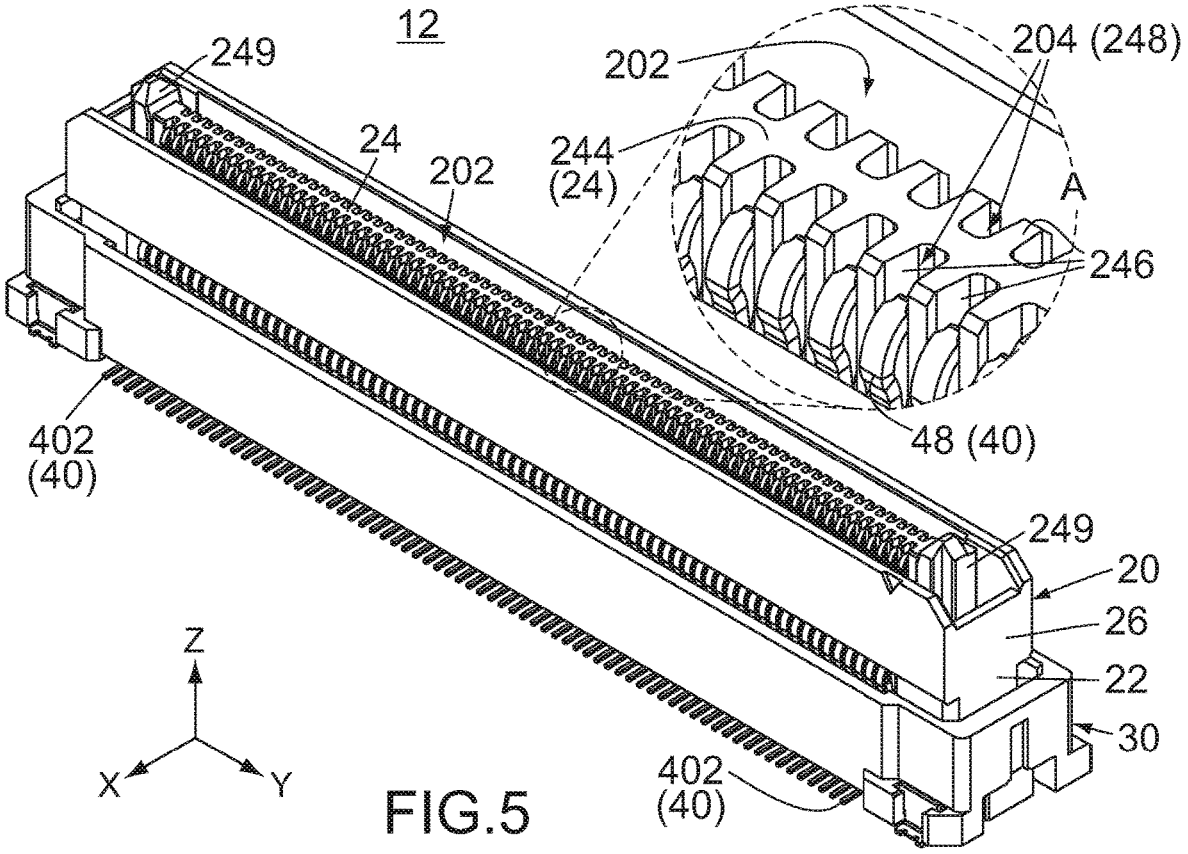
FIG. 5 is a perspective view showing the first connector of the connector assembly of FIG. 1, wherein a part of the first connector enclosed by dashed line A is enlarged to be illustrated.

Referring to FIG. 5, the first connector 12 of the present embodiment comprises a first housing (movable housing) 20 made of insulator, a fixed housing 30 made of insulator and a plurality of first contacts 40 each made of conductor. However, the first connector 12 does not need to comprise the fixed housing 30. Alternatively, the first connector 12 may further comprise another member in addition to the first housing 20, the fixed housing 30 and the first contacts 40.

Referring to FIG. 2, the fixed housing 30 is mounted on the first circuit board 82 when the first connector 12 is used. The first housing 20 is arranged above the fixed housing 30, or arranged on a position which the positive Z-side of the fixed housing 30 faces in the Z-direction, as a whole. The first housing 20 is supported by the fixed housing 30 and is movable relative to the fixed housing 30 in a horizontal plane (XY-plane) perpendicular to the Z-direction.

Figure 8:
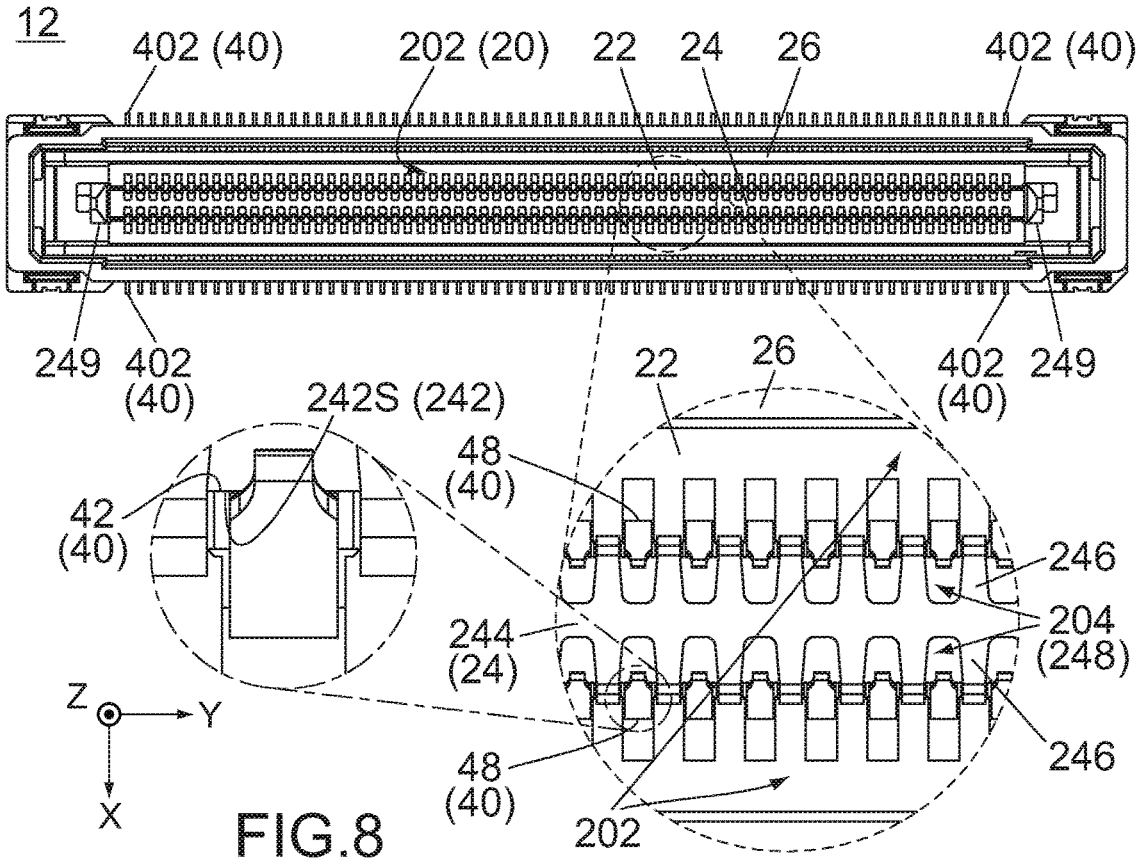
FIG. 8 is a plan view showing the first connector of FIG. 5, wherein a part of the first connector enclosed by dashed line is enlarged to be illustrated, and a part of the enlarged view enclosed by chain dotted lines is further enlarged to be illustrated.

Referring to FIG. 5, the first housing 20 has a bottom 22, an island-like portion 24 and a first peripheral wall 26. The bottom 22 is a lower part, or the negative Z-side part, of the first housing 20 and is partially received in the fixed housing 30. Referring to FIGS. 5 and 8, the island-like portion 24 projects upward from the middle of the bottom 22 in the XY-plane while extending long along a pitch direction (Y-direction) perpendicular to the Z-direction. The first peripheral wall 26 extends upward from the bottom 22 while enclosing the island-like portion 24 in the XY-plane.

Figure 14:
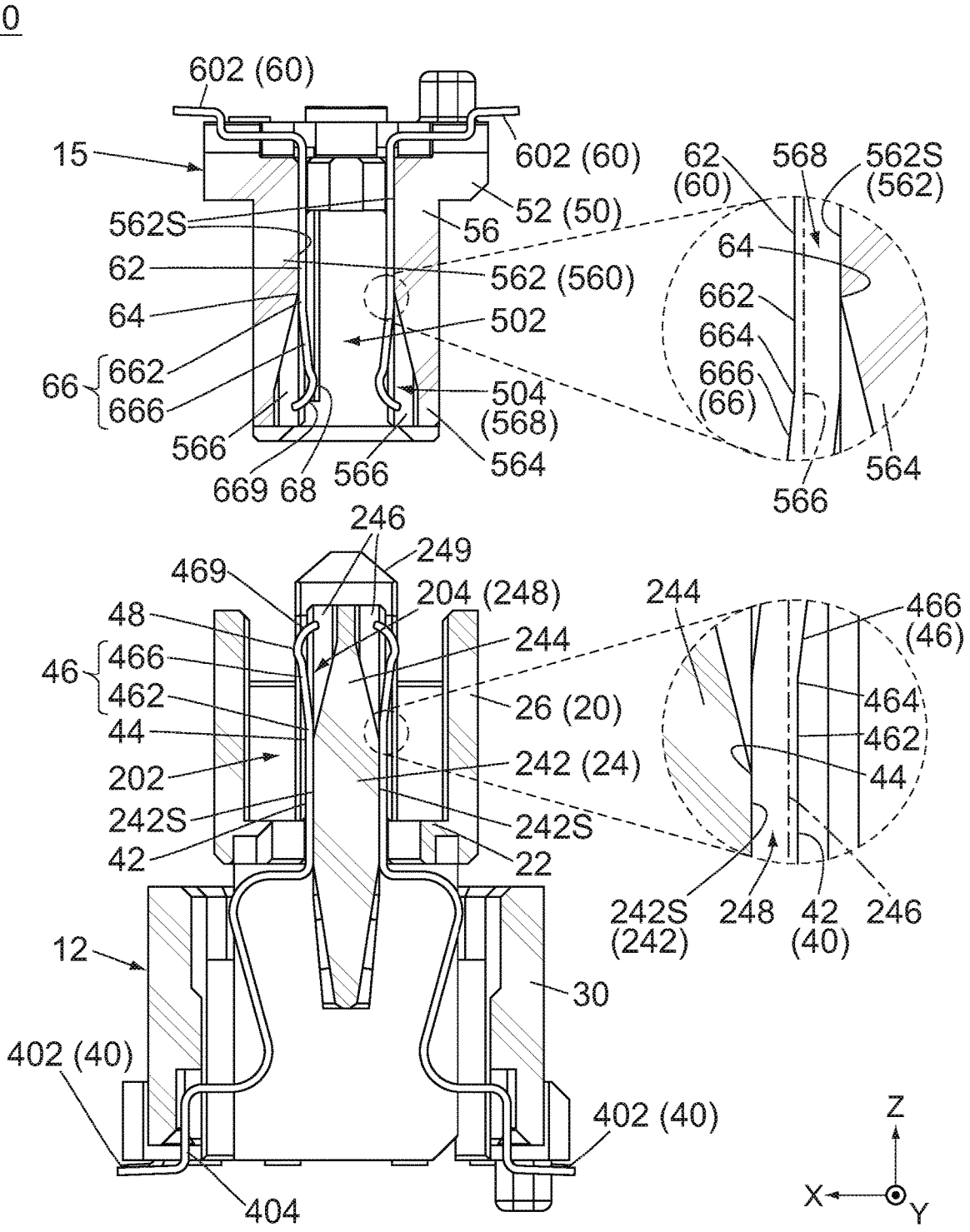
FIG. 14 is a cross-sectional view showing the connector assembly of FIG. 1, wherein a part of the first connector enclosed by dashed line and a part of the second connector enclosed by dashed line are enlarged to be illustrated, and chain dotted lines in the enlarged views illustrate an outline of a hidden first partition and an outline of a hidden second partition.
Figure 15:
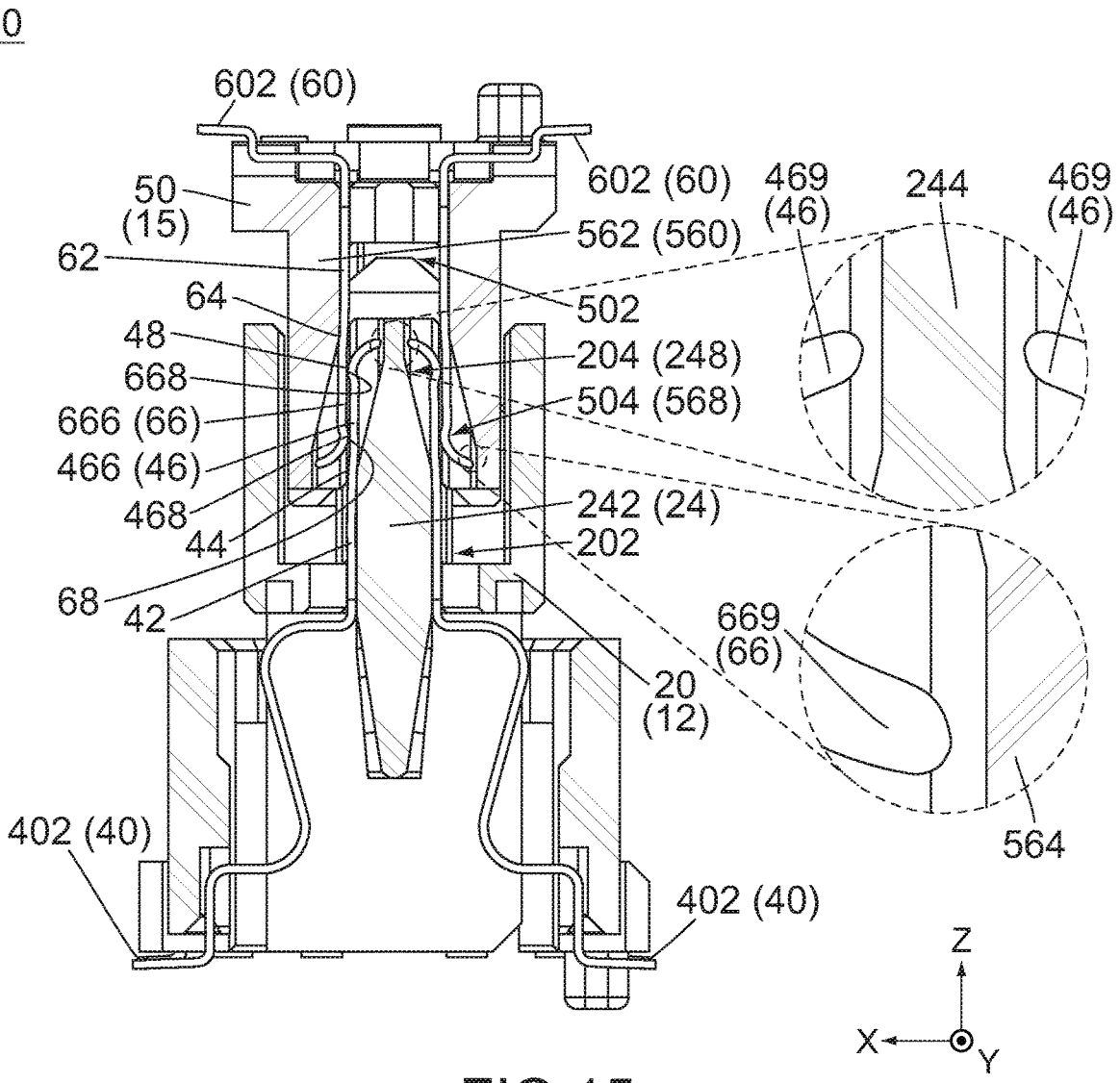
FIG. 15 is a cross-sectional view showing the connector assembly of FIG. 14, wherein the first connector and the second connector are shallowly mated with each other, and a part of the first connector enclosed by dashed line and a part of the second connector enclosed by dashed line are enlarged to be illustrated.
Figure 16:
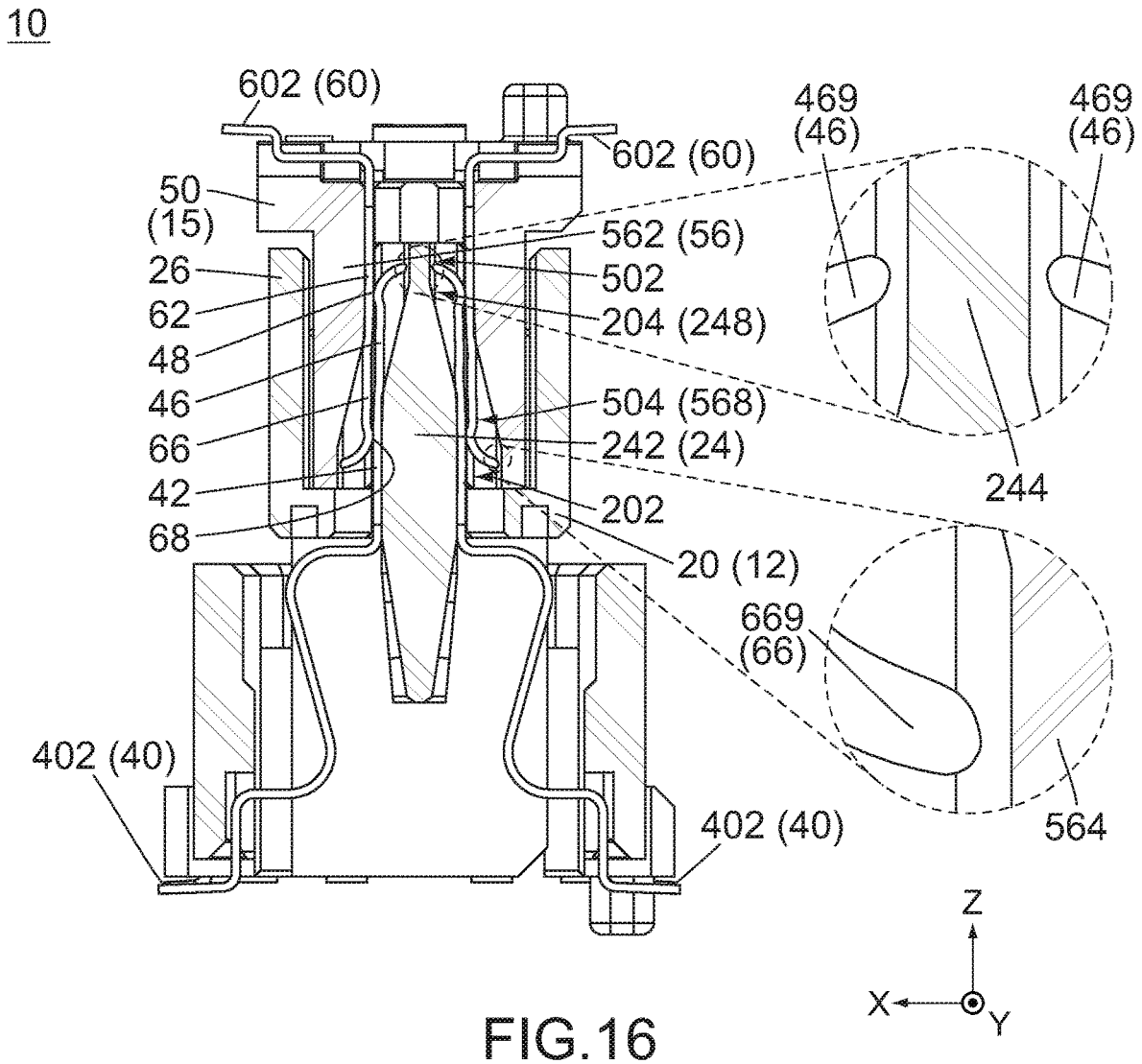
FIG. 16 is a cross-sectional view showing the connector assembly of FIG. 14, wherein the first connector and the second connector are deeply mated with each other, and a part of the first connector enclosed by dashed line and a part of the second connector enclosed by dashed line are enlarged to be illustrated.
Figure 17:
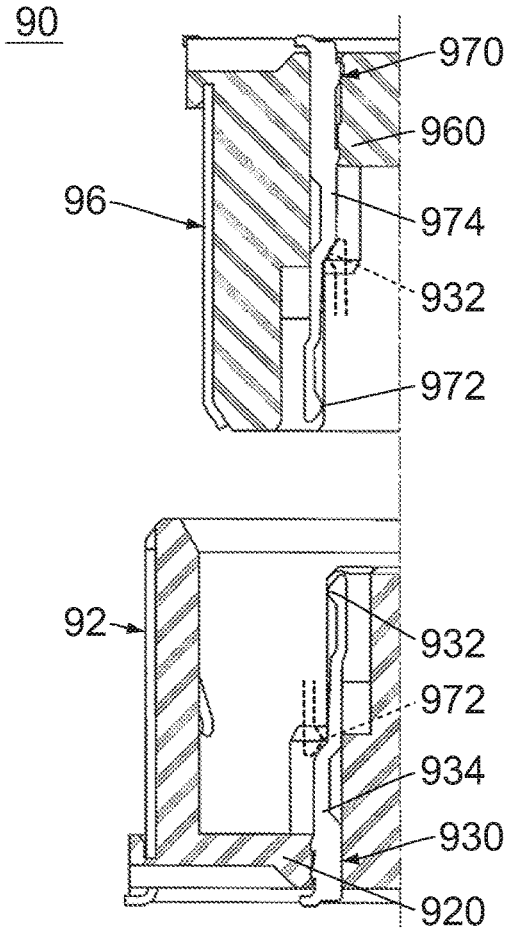
FIG.17 PRIOR ART
FIG. 17 is a cross-sectional view showing a connector assembly of Patent Document 1, wherein a receptacle connector and a plug connector of the connector assembly are separated from each other.
Figure 18:
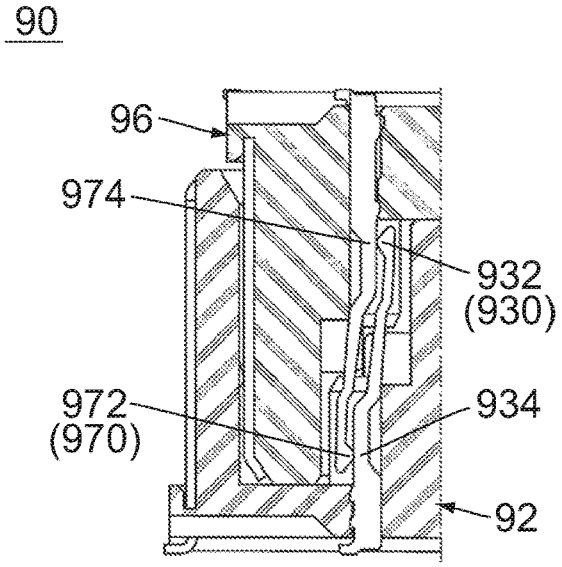
FIG.18 PRIOR ART
FIG. 18 is a cross-sectional view showing the connector assembly of FIG. 17, wherein the receptacle connector and the plug connector are mated with each other.

The first housing 20 is formed with a first receiving portion 202. The first receiving portion 202 is a space which is enclosed by the first peripheral wall 26 in the XY-plane. The first receiving portion 202 encloses the island-like portion 24 in the XY-plane. Referring to FIGS. 14 to 16, the first receiving portion 202 opens upward under a separated state where the first connector 12 and the second connector 15 are separated from each other as shown in FIG. 14. The first receiving portion 202 receives, at least in part, the second connector 15 when the first connector 12 and the second connector 15 are mated with each other.

Referring to FIGS. 5, 8 and 14, the first housing 20 has a first support portion 242, a separation wall 244 and two first positioning portions 249. The two first positioning portions 249 are located at opposite ends of the island-like portion 24 in the Y-direction, respectively. Each of the first support portion 242 and the separation wall 244 is located between the two first positioning portions 249 in the Y-direction and is located adjacent to the first receiving portion 202 in the X-direction perpendicular to both the Y-direction and the Z-direction. Referring to FIG. 14, the first support portion 242 is a lower part of the island-like portion 24 and projects upward from the bottom 22. The separation wall 244 is an upper part, or the positive Z-side part, of the island-like portion 24 and projects upward from an upper end (positive Z-side end) of the first support portion 242. Each of the first positioning portions 249 projects upward beyond an upper end of the separation wall 244.

Figure 6:
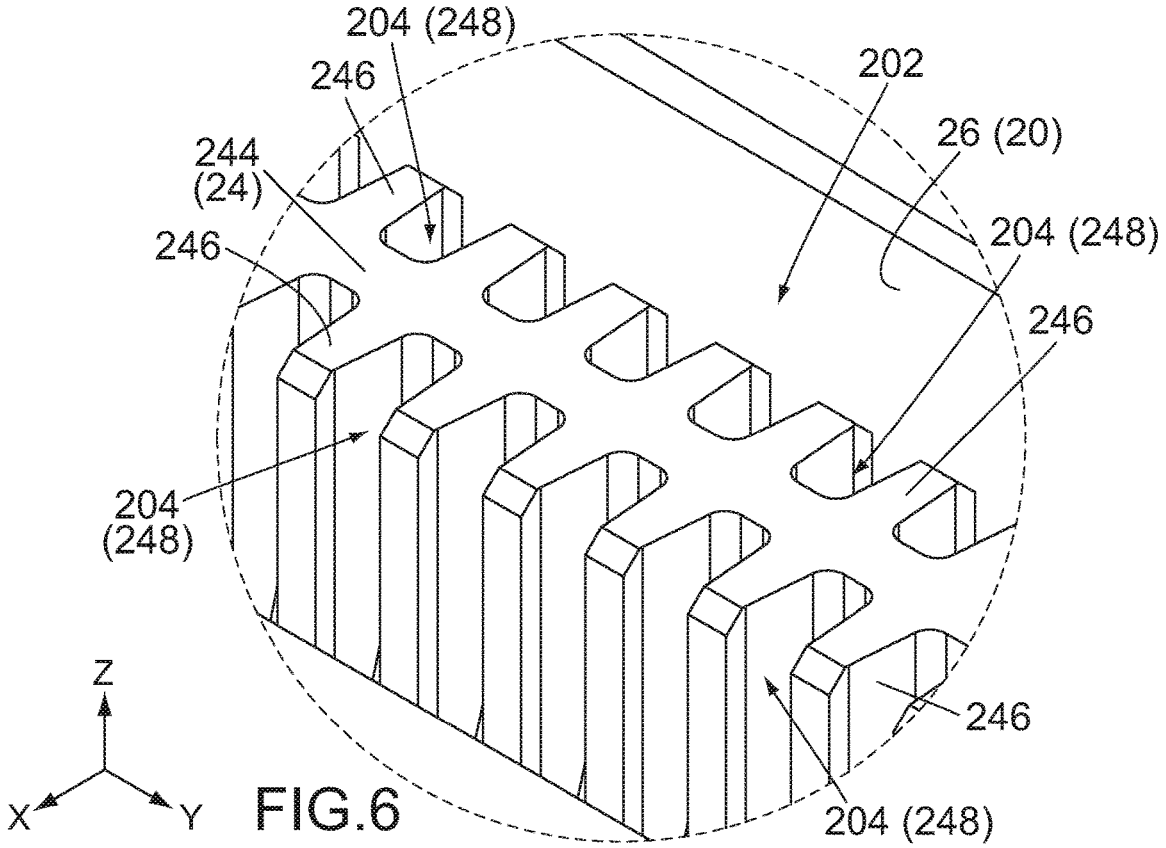
FIG. 6 is a perspective view showing a part of a first housing of the first connector enclosed by dashed line A of FIG. 5.

Referring to FIGS. 5, 6 and 8, the island-like portion 24 is formed with a plurality of first recesses 248. Each of the first recesses 248 is formed so that one of opposite side surfaces of the island-like portion 24 in the X-direction is partially recessed inward in the X-direction. The thus-shaped island-like portion 24 is formed with a plurality of first partition walls 246. Each of the first recesses 248 is a space which is located between adjacent two of the first partition walls 246 in the Y-direction. The first recesses 248 are grouped into two rows in the X-direction. The first recesses 248 of each row have shapes same one another and are arranged at regular intervals in the Y-direction. The two rows of the first recesses 248 are arranged to be mirror images of each other with respect to the YZ-plane. However, the present invention is not limited thereto, but the shapes and the arrangement of the first recesses 248 can be variously modified as necessary.

Referring to FIG. 14, each of the first recesses 248 is formed so as to extend from the separation wall 244 to the first support portion 242 in the Z-direction. Thus, each of the first recesses 248 includes an upper part formed in the separation wall 244 and a lower part formed in the first support portion 242. In each of the first recesses 248, the upper part is largely recessed inward in the X-direction, and the lower part is slightly recessed inward in the X-direction. The first support portion 242 has a plurality of first support surfaces 242S which correspond to the first recesses 248, respectively. Each of the first support surfaces 242S is a part of one of opposite side surfaces of the first support portion 242 in the X-direction. In detail, each of the first support surfaces 242S is a wall surface of the lower part of the corresponding first recess 248 and is a vertical plane perpendicular to the X-direction.

According to the present embodiment, the upper part of each of the first recesses 248 works as a first movement-allowing portion 204 as described later. In other words, the first housing 20 is formed with a plurality of the first movement-allowing portions 204 each of which is the upper part of one of the first recesses 248. Each of the first movement-allowing portions 204 is located above the first support portion 242 and communicates with the first receiving portion 202 in the X-direction. Thus, each of the first movement-allowing portions 204 is located adjacent to the first receiving portion 202 in the X-direction.

According to the present embodiment, each of the first movement-allowing portions 204 includes a space which is located right over the first support portion 242 and another space which protrudes outward in the X-direction slightly beyond the first support portion 242. However, the present invention is not limited thereto. For example, referring to FIGS. 5 and 6, each of the first recesses 248 may be formed only in the separation wall 244. In other words, the first support portion 242 (see FIG. 14) may be formed with none of the first recesses 248. According to this structure, each of the first recesses 248 entirely works as the first movement-allowing portion 204, and the whole of each of the first movement-allowing portions 204 is located right over the first support portion 242. Moreover, the island-like portion 24 may have none of the first partition walls 246. According to this structure, the first housing 20 is formed with two of the first movement-allowing portions 204. These two first movement-allowing portions 204 are located on opposite sides of the separation wall 244 in the X-direction, respectively, and are located between the two first positioning portions 249 in the Y-direction.

The first housing 20 of the present embodiment has the aforementioned structure. However, referring to FIG. 14, the structure of the first housing 20 is not limited thereto, provided that the first housing 20 has one or more of the first support portions 242 and is formed with one or more of the first receiving portions 202 and one or more of the first movement-allowing portions 204. For example, each of the separation wall 244 and the first peripheral wall 26 may be provided as necessary. Moreover, the first support portion 242 does not need to be a part of the island-like portion 24.

Figure 7:
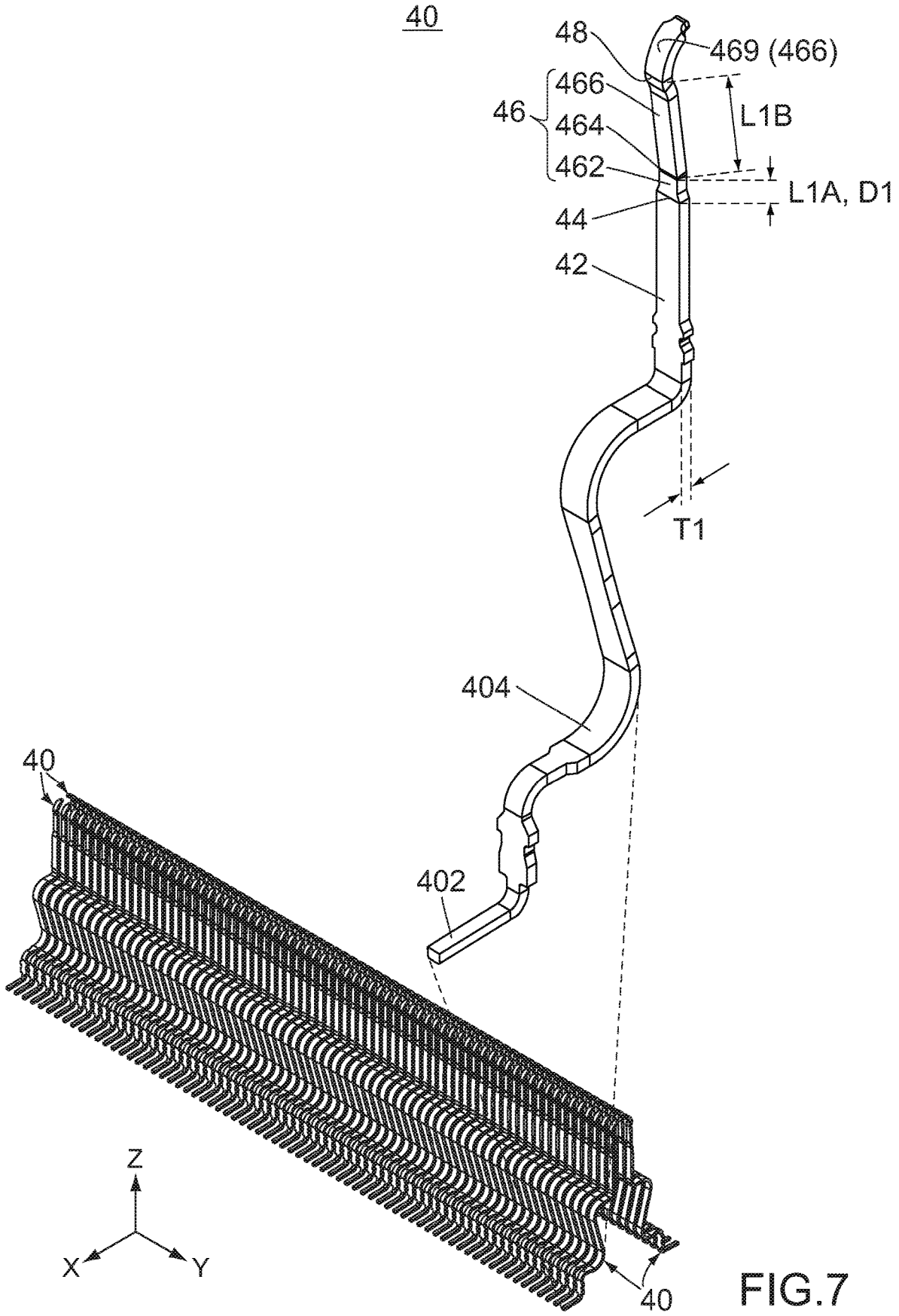
FIG. 7 is a perspective view showing first contacts of the first connector of FIG. 5, wherein one of the first contacts is enlarged to be illustrated.

Referring to FIGS. 5 and 7, the first contacts 40 of the present embodiment have shapes same one another and are grouped into two rows in the X-direction so as to correspond to the first recesses 248, respectively. The two rows of the first contacts 40 are arranged to be mirror images of each other with respect to the YZ-plane. The first contacts 40 of each row are arranged at regular intervals in the Y-direction. Referring to FIG. 5, each of the first contacts 40 is received in the corresponding first recess 248 and held by the first housing 20 and the fixed housing 30. However, the present invention is not limited thereto. For example, the first contacts 40 may have shapes different from one another. Moreover, the first connector 12 may comprise only one of the first contacts 40.

Hereafter, explanation will be made about one of the first contacts 40. The explanation described below is applicable to each of the first contacts 40 of the present embodiment.

Referring to FIG. 7, the first contact 40 of the present embodiment is a bending contact which is formed by bending a single metal plate having a flat plate-like shape. In other words, the first contact 40 is a single metal plate with bends. The first contact 40 has a first fixed portion 402, a first coupling portion 404, a first supported portion 42, a first resiliently-support portion 46 and a first contact point 48. The aforementioned parts of the first contact 40 have plate thicknesses almost same as one another.

The first fixed portion 402 extends along the X-direction. The first coupling portion 404 has a meander shape which extends upward from an inner end of the first fixed portion 402 in the X-direction. The first supported portion 42 extends upward from an upper end of the first coupling portion 404. Thus, the first coupling portion 404 couples the first fixed portion 402 and the first supported portion 42 to each other. The first resiliently-support portion 46, as a whole, extends upward and outward in the X-direction from an upper end of the first supported portion 42 and is resiliently deformable. The first resiliently-support portion 46 has a part which is located in the vicinity of an upper end thereof and protrudes outward in the X-direction to form an arc shape. Thus, the first resiliently-support portion 46 is formed with the first contact point 48 and a first guide portion 469. The first contact point 48 is supported by the first resiliently-support portion 46 and is movable in the X-direction in accordance with resilient deformation of the first resiliently-support portion 46. The first guide portion 469 extends upward and inward in the X-direction from the first contact point 48 while being gently curved.

Referring to FIG. 14 together with FIG. 7, in the present embodiment, a lower end of the first coupling portion 404 is press-fit into and held by the fixed housing 30, and a lower end of the first supported portion 42 is press-fit into and held by the bottom 22 of the first housing 20. Referring to FIG. 2, the first fixed portion 402 is exposed downward from the fixed housing 30 and is fixed on and connected to a conductive pad (not shown) of the first circuit board 82 via soldering, etc. when the first connector 12 is used. Referring to FIG. 14, the first coupling portion 404 supports the first housing 20 so that the first housing 20 is movable in the XY-plane. However, the present invention is not limited thereto. For example, when the first connector 12 does not comprise the fixed housing 30, the first coupling portion 404 may be press-fit into and held by the bottom 22 of the first housing 20. Moreover, the first contact 40 may be partially embedded in the first housing 20 via insert-molding.

Referring to FIG. 14, the first supported portion 42 extends in the Z-direction along a boundary between the first support portion 242 and the first receiving portion 202. In particular, the first supported portion 42 of the present embodiment extends straight upward from the bottom 22 along the Z-direction. According to the present embodiment, the most part of the first supported portion 42 is arranged in the first recess 248. According to this arrangement, the first supported portion 42 linearly extends in the Z-direction along the first recess 248 while being regulated so as not to be moved in the Y-direction. Meanwhile, a part of the first supported portion 42, particularly an outer surface thereof in the X-direction, is exposed in the first receiving portion 202. However, the present invention is not limited thereto. For example, the first support portion 242 may be provided with the first recess 248 as necessary. When the first support portion 242 is not provided with the first recess 248, the first supported portion 42 may be entirely located in the first receiving portion 202.

According to the present embodiment, the first supported portion 42 is partially fixed to the bottom 22 and is in contact with or close to the first support surface 242S (vertical plane) of the first support portion 242. Thus, the first supported portion 42 is securely supported by the first support portion 242, and the first support portion 242 prevents a movement of the first supported portion 42 toward the first support portion 242. In other words, the first supported portion 42 is supported by the first support portion 242 not to be moved in the X-direction. However, the aforementioned support structure can be variously modified. For example, the first support surface 242S may intersect with the X-direction. In other words, the first support surface 242S may be oblique to the X-direction to some extent. According to this structure, the first supported portion 42 may extend upward along the first support surface 242S while sloping. Moreover, the first supported portion 42 may be embedded in the first support portion 242 while the outer surface thereof in the X-direction is exposed.

The first resiliently-support portion 46 extends from the first supported portion 42 while being apart from the first support portion 242 in the X-direction. In other words, the first resiliently-support portion 46 is a part of the first contact 40 which extends so as to be apart from the first support portion 242 and the first supported portion 42.

Referring to FIG. 14 together with FIG. 7, the first contact 40 has a first starting point 44. The first starting point 44 is located at a boundary between the first supported portion 42 and the first resiliently-support portion 46. Thus, the first supported portion 42 extends upward to the first starting point 44, and the first resiliently-support portion 46 extends upward from the first starting point 44. According to the present embodiment, the first resiliently-support portion 46 has a lower end part which has a shape different from that of an upper end part of the first supported portion 42, so that the first starting point 44 can be visually and clearly identified even under a state where the first contact 40 is not held by the first housing 20. However, the present invention is not limited thereto, but no clear boundary may be provided between the first supported portion 42 and the first resiliently-support portion 46. More specifically, the lower end part of the first resiliently-support portion 46 may have a shape same as that of the upper end part of the first supported portion 42.

The first resiliently-support portion 46 of the present embodiment is bent to have a first vertical portion 462, a first bending point 464 and a first sloping portion 466. The first vertical portion 462 linearly extends upward from the first starting point 44 to the first bending point 464 along the Z-direction. The first sloping portion 466 extends upward and outward in the X-direction from the first bending point 464, so that the first sloping portion 466 slopes and is apart from the first support portion 242 in each of the Z-direction and the X-direction. The first contact point 48 and the first guide portion 469 are located at an upper end of the first sloping portion 466. The first bending point 464 of the present embodiment can be visually and clearly identified. However, the first resiliently-support portion 46 does not need to have the first bending point 464 which can be clearly identified. According to this structure, the first resiliently-support portion 46 may extend upward and outward in the X-direction from the first starting point 44 so as to have a linear shape or a gently curved shape. In other words, the first resiliently-support portion 46 may have only the first sloping portion 466 which slopes in a perpendicular plane (XZ-plane) perpendicular to the Y-direction.

Referring to FIG. 14, according to the present embodiment, the first resiliently-support portion 46 is apart from the first support portion 242 in the X-direction and is located above the first support portion 242 in the Z-direction. In detail, in the Z-direction, a position of the first starting point 44 is equal to another position of the upper end of the first support portion 242. However, the present invention is not limited thereto. For example, the first resiliently-support portion 46 may have no first vertical portion 462, and the first sloping portion 466 may extend directly from the first starting point 44. According to this structure, the first starting point 44 may be located below the upper end of the first support portion 242. In other words, the lower end of the first resiliently-support portion 46 may be located adjacent to the first support portion 242 in the X-direction.

Under the separated state, the first contact point 48 is located in the first receiving portion 202 and is apart from the first support portion 242 in each of the Z-direction and the X-direction. When the first contact point 48 receives a force directed inward in the X-direction, the first resiliently-support portion 46 is resiliently deformed, and the first contact point 48 is moved toward the separation wall 244 through the first receiving portion 202. Meanwhile, an inner end of the first guide portion 469 in the X-direction is moved through the first movement-allowing portion 204 with no abutment with the separation wall 244. In other words, under the separated state, the first movement-allowing portion 204 allows the first contact point 48 to be moved in the X-direction in accordance with resilient deformation of the first resiliently-support portion 46.

Hereafter, explanation will be made about a structure of the second connector 15.

Figure 9:
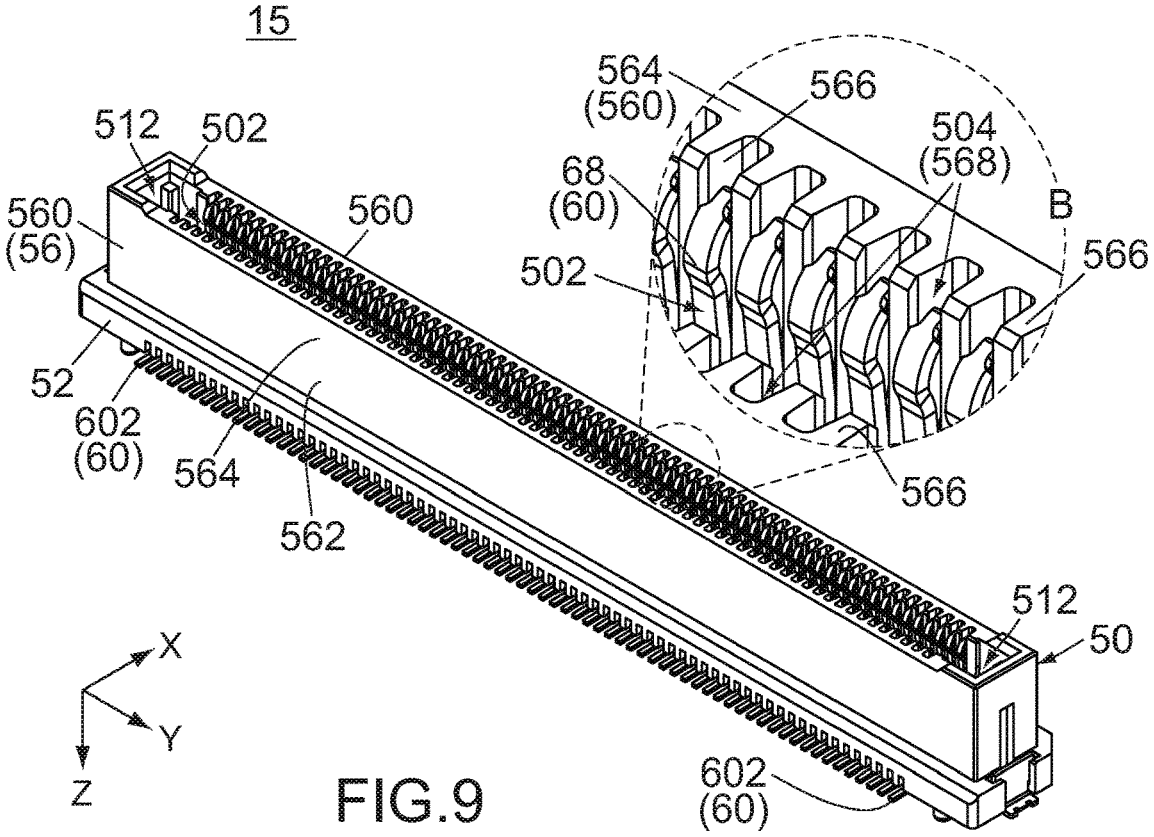
FIG. 9 is a perspective view showing the second connector of the connector assembly of FIG. 1, wherein a part of the second connector enclosed by dashed line B is enlarged to be illustrated.

Referring to FIG. 9, the second connector 15 comprises a second housing 50 made of insulator and a plurality of second contacts 60 each made of conductor. The second contacts 60 correspond to the first contacts 40 (see FIG. 5), respectively. The second connector 15 may further comprises another member in addition to the second housing 50 and the second contacts 60.

Figure 13:
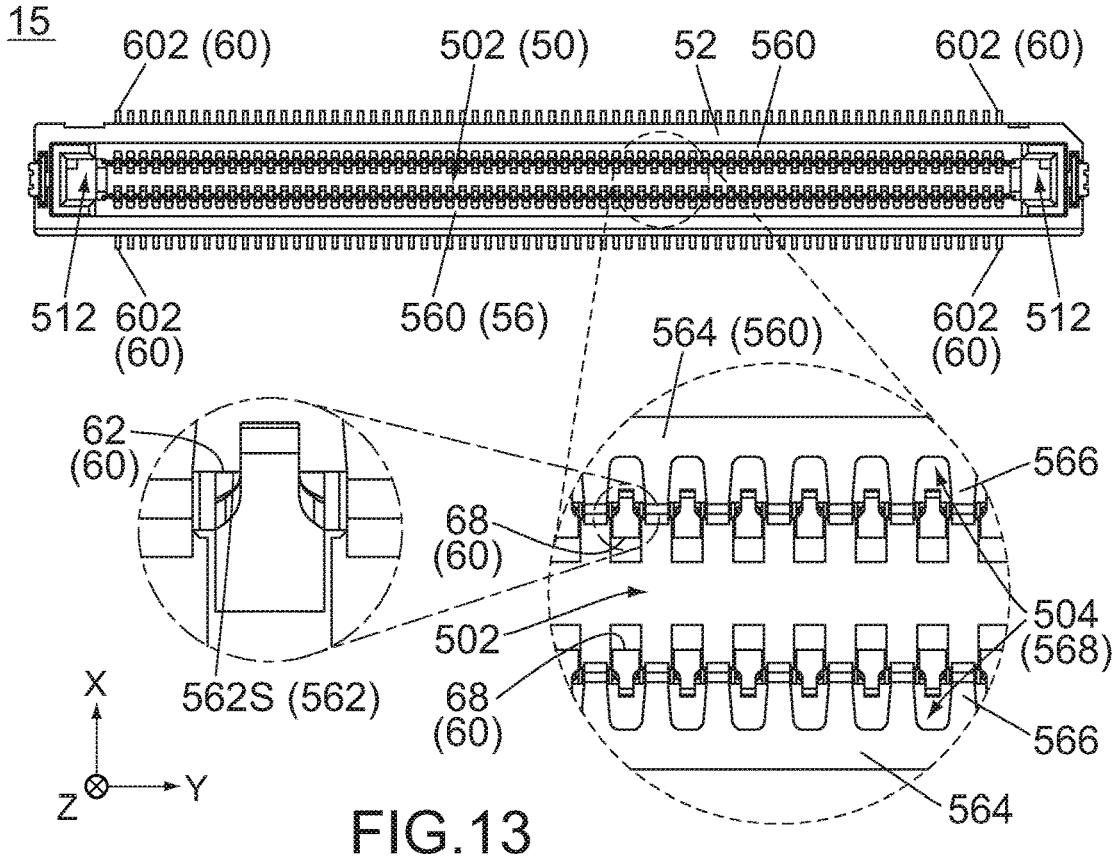
FIG. 13 is a plan view showing the second connector of FIG. 9, wherein a part of the second connector enclosed by dashed line is enlarged to be illustrated, and a part of the enlarged view enclosed by chain dotted lines is further enlarged to be illustrated.

The second housing 50 has a base portion 52 and a second peripheral wall 56. Referring to FIG. 2, the base portion 52 is mounted on the second circuit board 85 when the second connector 15 is used. Referring to FIGS. 9 and 13, the second peripheral wall 56 extends along a periphery of the base portion 52 in the XY-plane and extends away from the base portion 52 in the Z-direction.

The second housing 50 is formed with a second receiving portion 502. The second receiving portion 502 is a space which is enclosed by the second peripheral wall 56 in the XY-plane. The second receiving portion 502 has two second positioning portions 512. The second positioning portions 512 are recesses which are located at opposite ends of the second receiving portion 502 in the Y-direction, respectively. Referring to FIGS. 14 to 16, the second receiving portion 502 opens downward under the separated state. The second receiving portion 502 receives, at least in part, the first connector 12 when the first connector 12 and the second connector 15 are mated with each other.

Referring to FIGS. 9 and 13, the second peripheral wall 56 has two sidewalls 560. Each of the sidewalls 560 extends along the YZ-plane. The two sidewalls 560 are located across the second receiving portion 502 from each other in the X-direction. Referring to FIGS. 9, 13 and 14, each of the sidewalls 560 has a second support portion 562 and a protection wall 564. Thus, the second housing 50 has the two second support portions 562 and the two protection walls 564. In the present embodiment, the two sidewalls 560 have a mirror-symmetrical shape with respect to the YZ-plane. However, the present invention is not limited thereto. For example, the two sidewalls 560 may have an asymmetrical shape with respect to the YZ-plane. In this case, only one of the sidewalls 560 may have the second support portion 562.

Hereafter, explanation will be made about one of the two sidewalls 560. The explanation described below is applicable to each of the sidewalls 560 of the present embodiment.

Referring to FIGS. 9, 13 and 14, each of the second support portion 562 and the protection wall 564 is located between opposite ends of the sidewall 560 in the Y-direction and is located adjacent to the second receiving portion 502 in the X-direction. Referring to FIG. 14, the second support portion 562 is an upper part of the sidewall 560 and projects downward from the base portion 52. The protection wall 564 is a lower part of the sidewall 560 and projects downward from a lower end of the second support portion 562.

Figure 10:
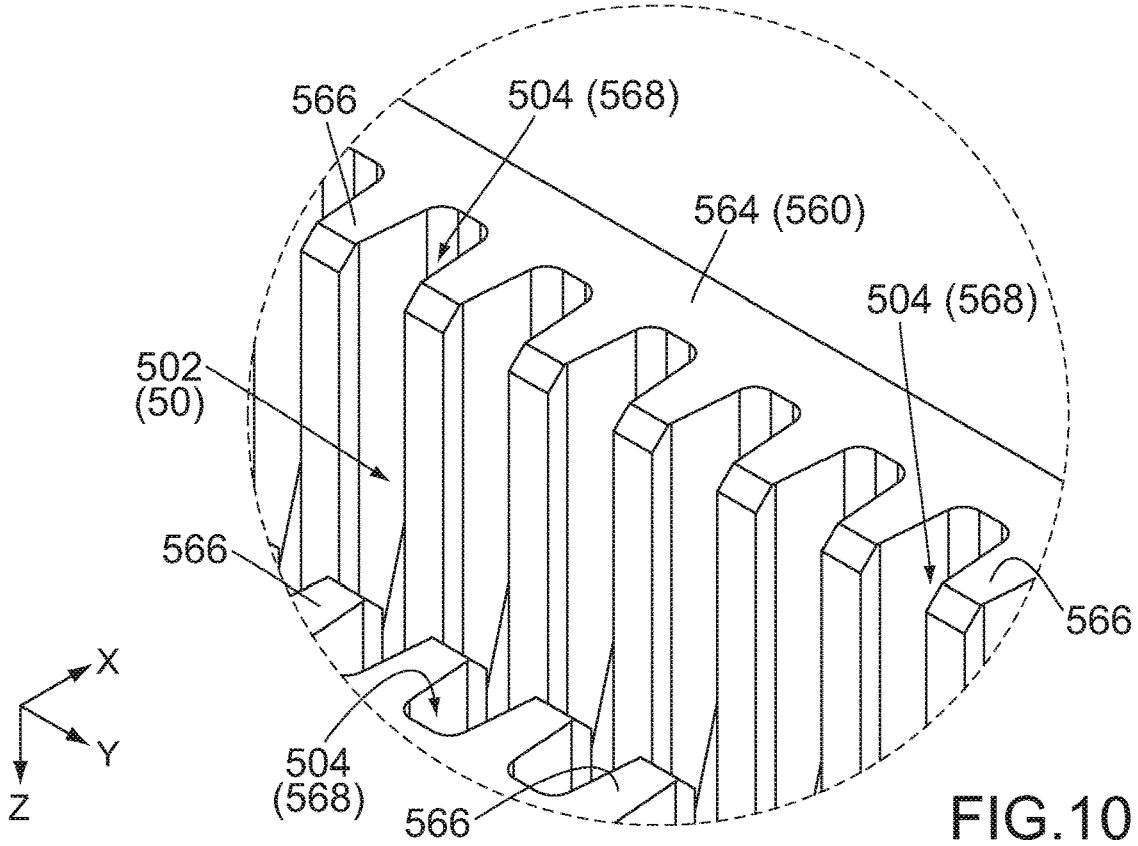
FIG. 10 is a perspective view showing a part of a second housing of the second connector enclosed by dashed line B of FIG. 9.

Referring to FIGS. 9, 10 and 13, the sidewall 560 is formed with a plurality of second recesses 568. Each of the second recesses 568 is formed so that an inner side surface of the sidewall 560 in the X-direction is partially recessed outward in the X-direction. The thus-shaped sidewall 560 is formed with a plurality of second partition walls 566. Each of the second recesses 568 is a space which is located between adjacent two of the second partition walls 566 in the Y-direction. The second recesses 568 have shapes same as one another and are arranged at regular intervals in the Y-direction. However, the present invention is not limited thereto, but the shapes and the arrangement of the second recesses 568 can be variously modified as necessary.

Referring to FIG. 14, each of the second recesses 568 is formed so as to extend from the protection wall 564 to the second support portion 562 in the Z-direction. Thus, each of the second recesses 568 includes a lower part formed in the protection wall 564 and an upper part formed in the second support portion 562. In each of the second recesses 568, the lower part is largely recessed outward in the X-direction, and the upper part is slightly recessed outward in the X-direction. The second support portion 562 has a plurality of second support surfaces 562S which correspond to the second recesses 568, respectively. Each of the second support surfaces 562S is a part of an inner side surface of the second support portion 562 in the X-direction. In detail, each of the second support surfaces 562S is a wall surface of the upper part of the corresponding second recess 568 and is a vertical plane perpendicular to the X-direction.

According to the present embodiment, the lower part of each of the second recesses 568 works as a second movement-allowing portion 504 as described later. In other words, the second housing 50 is formed with a plurality of the second movement-allowing portions 504 each of which is the lower part of one of the second recesses 568. Each of the second movement-allowing portions 504 is located below the second support portion 562 and communicates with the second receiving portion 502 in the X-direction. Thus, each of the second movement-allowing portions 504 is located adjacent to the second receiving portion 502 in the X-direction.

According to the present embodiment, each of the second movement-allowing portions 504 includes a space which is located right under the second support portion 562 and another space which protrudes inward in the X-direction slightly beyond the second support portion 562. However, the present invention is not limited thereto. For example, referring to FIGS. 9 and 10, each of the second recesses 568 may be formed only in the protection wall 564. In other words, the second support portion 562 (see FIG. 14) may be formed with none of the second recesses 568. According to this structure, each of the second recesses 568 entirely works as the second movement-allowing portion 504, and the whole of each of the second movement-allowing portions 504 is located right under the second support portion 562. Moreover, the sidewall 560 may have none of the second partition walls 566. According to this structure, the sidewall 560 is formed with one of the second movement-allowing portions 504. This second movement-allowing portion 504 is located between the opposite ends of the sidewall 560 in the Y-direction.

The second housing 50 of the present embodiment has the aforementioned structure. However, referring to FIG. 14, the structure of the second housing 50 is not limited thereto, provided that the second housing 50 has one or more of the second support portions 562 and is formed with one or more of the second receiving portions 502 and one or more of the second movement-allowing portions 504. For example, the protection wall 564 may be provided as necessary. Moreover, the second support portion 562 does not need to be a part of the sidewall 560.

Figure 11:
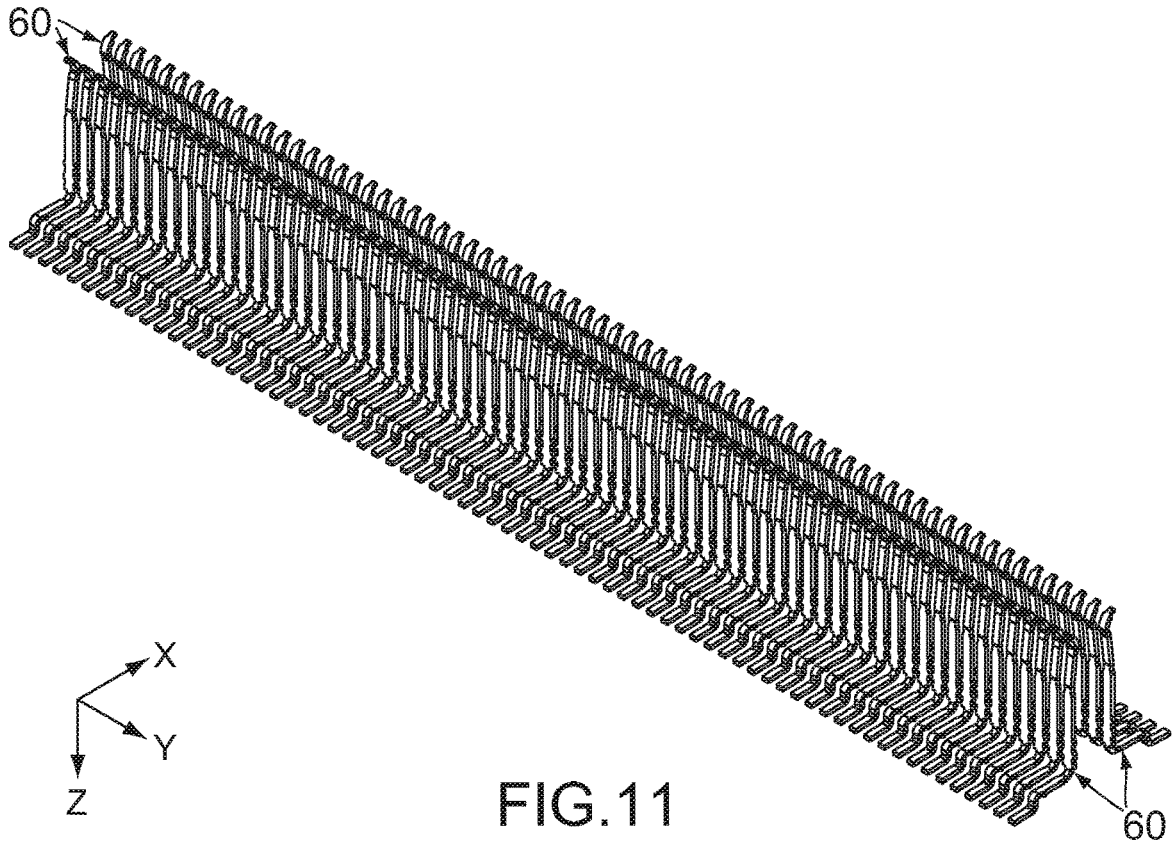
FIG. 11 is a perspective view showing second contacts of the second connector of FIG. 9.

Referring to FIGS. 9 and 11, the second contacts 60 of the present embodiment have shapes same one another and are grouped into two rows in the X-direction so as to correspond to the second recesses 568, respectively. The two rows of the second contacts 60 are arranged to be mirror images of each other with respect to the YZ-plane. The second contacts 60 of each row are arranged at regular intervals in the Y-direction. Referring to FIG. 9, each of the second contacts 60 is received in the corresponding second recess 568 and held by the second housing 50. However, the present invention is not limited thereto. For example, the second contacts 60 may have shapes different from one another. Moreover, the second connector 15 may comprise only one of the second contacts 60.

Hereafter, explanation will be made about one of the second contacts 60. The explanation described below is applicable to each of the second contacts 60 of the present embodiment.

Figure 12:
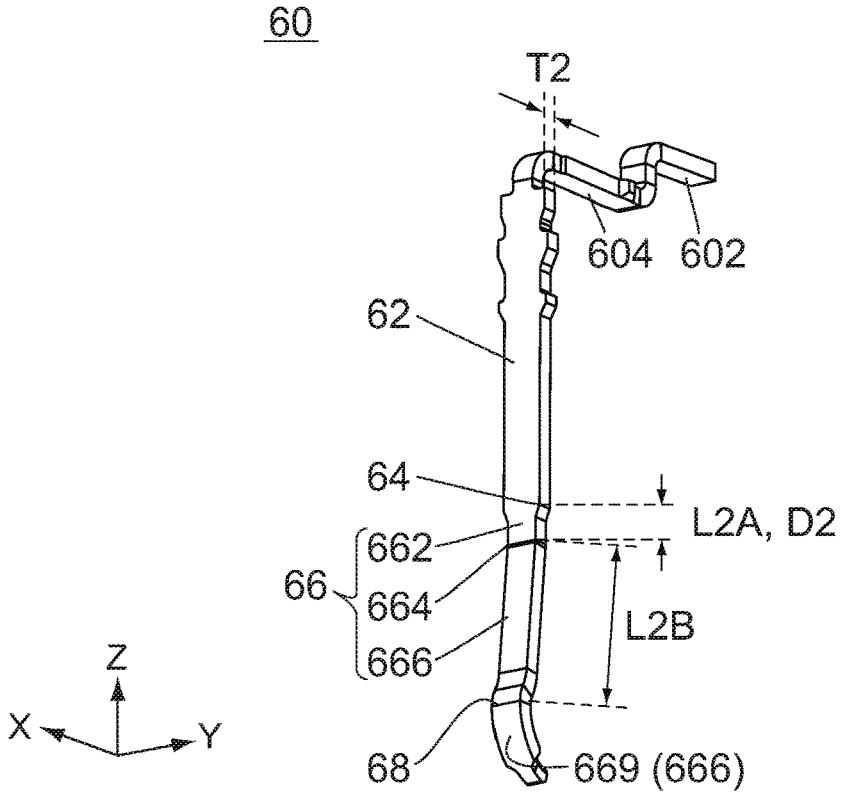
FIG. 12 is a perspective view showing one of the second contacts of FIG. 11.

Referring to FIG. 12, the second contact 60 of the present embodiment is a bending contact which is formed by bending a single metal plate having a flat plate-like shape. In other words, the second contact 60 is a single metal plate with bends. The second contact 60 has a second fixed portion 602, a second coupling portion 604, a second supported portion 62, a second resiliently-support portion 66 and a second contact point 68. The aforementioned parts of the second contact 60 have plate thicknesses almost same as one another.

The second fixed portion 602 extends along the X-direction. The second coupling portion 604 extends inward in the X-direction as a whole from an inner end of the second fixed portion 602 in the X-direction. The second supported portion 62 extends downward from an inner end of the second coupling portion 604 in the X-direction. Thus, the second coupling portion 604 couples the second fixed portion 602 and the second supported portion 62 to each other. The second resiliently-support portion 66, as a whole, extends downward and inward in the X-direction from a lower end of the second supported portion 62 and is resiliently deformable. The second resiliently-support portion 66 has a part which is located in the vicinity of a lower end thereof and protrudes inward in the X-direction to form an arc shape. Thus, the second resiliently-support portion 66 is formed with the second contact point 68 and a second guide portion 669. The second contact point 68 is supported by the second resiliently-support portion 66 and is movable in the X-direction in accordance with resilient deformation of the second resiliently-support portion 66. The second guide portion 669 extends downward and outward in the X-direction from the second contact point 68 while being gently curved.

Referring to FIG. 14 together with FIG. 12, in the present embodiment, a part of the second coupling portion 604 and an upper end of the second supported portion 62 are press-fit into and held by the base portion 52 of the second housing 50. Referring to FIG. 2, the second fixed portion 602 is exposed upward from the second housing 50 and is fixed on and connected to a conductive pad (not shown) of the second circuit board 85 via soldering, etc. when the second connector 15 is used. However, the present invention is not limited thereto. For example, the second contact 60 may be partially embedded in the second housing 50 via insert-molding.

Referring to FIG. 14, the second supported portion 62 extends in the Z-direction along a boundary between the second support portion 562 and the second receiving portion 502. In particular, the second supported portion 62 of the present embodiment extends straight downward from the base portion 52 along the Z-direction. According to the present embodiment, the most part of the second supported portion 62 is arranged in the second recess 568. According to this arrangement, the second supported portion 62 linearly extends in the Z-direction along the second recess 568 while being regulated so as not to be moved in the Y-direction.

Meanwhile, a part of the second supported portion 62, particularly an inner surface thereof in the X-direction, is exposed in the second receiving portion 502. However, the present embodiment can be variously modified. For example, the second support portion 562 may be provided with the second recess 568 as necessary. When the second support portion 562 is not provided with the second recess 568, the second supported portion 62 may be entirely located in the second receiving portion 502.

According to the present embodiment, the second supported portion 62 is partially fixed to the base portion 52 and is in contact with or close to the second support surface 562S (vertical plane) of the second support portion 562. Thus, the second supported portion 62 is securely supported by the second support portion 562, and the second support portion 562 prevents a movement of the second supported portion 62 toward the second support portion 562. In other words, the second supported portion 62 is supported by the second support portion 562 not to be moved in the X-direction. However, the aforementioned support structure can be variously modified. For example, the second support surface 562S may intersect with the X-direction. In other words, the second support surface 562S may be oblique to the X-direction to some extent. According to this structure, the second supported portion 62 may extend downward along the second support surface 562S while sloping. Moreover, the second supported portion 62 may be embedded in the second support portion 562 while the inner surface thereof in the X-direction is exposed.

The second resiliently-support portion 66 extends from the second supported portion 62 while being apart from the second support portion 562 in the X-direction. In other words, the second resiliently-support portion 66 is a part of the second contact 60 which extends so as to be apart from the second support portion 562 and the second supported portion 62.

Referring to FIG. 14 together with FIG. 12, the second contact 60 has a second starting point 64. The second starting point 64 is located at a boundary between the second supported portion 62 and the second resiliently-support portion 66. Thus, the second supported portion 62 extends downward to the second starting point 64, and the second resiliently-support portion 66 extends downward from the second starting point 64. According to the present embodiment, the second resiliently-support portion 66 has an upper end part which has a shape different from that of a lower end part of the second supported portion 62, so that the second starting point 64 can be visually and clearly identified even under a state where the second contact 60 is not held by the second housing 50. However, the present invention is not limited thereto, but no clear boundary may be provided between the second supported portion 62 and the second resiliently-support portion 66. More specifically, the upper end part of the second resiliently-support portion 66 may have a shape same as that of the lower end part of the second supported portion 62.

The second resiliently-support portion 66 of the present embodiment is bent to have a second vertical portion 662, a second bending point 664 and a second sloping portion 666. The second vertical portion 662 linearly extends downward from the second starting point 64 to the second bending point 664 along the Z-direction. The second sloping portion 666 extends downward and inward in the X-direction from the second bending point 664, so that the second sloping portion 666 slopes and is apart from the second support portion 562 in each of the Z-direction and the X-direction. The second contact point 68 and the second guide portion 669 are located at a lower end of the second sloping portion 666. The second bending point 664 of the present embodiment can be visually and clearly identified. However, the second resiliently-support portion 66 does not need to have the second bending point 664 which can be clearly identified. According to this structure, the second resiliently-support portion 66 may extend downward and inward in the X-direction from the second starting point 64 so as to have a linear shape or a gently curved shape. In other words, the second resiliently-support portion 66 may have only the second sloping portion 666 which slopes in the XZ-plane.

Referring to FIG. 14, according to the present embodiment, the second resiliently-support portion 66 is apart from the second support portion 562 in the X-direction and is located below the second support portion 562 in the Z-direction. In detail, in the Z-direction, a position of the second starting point 64 is equal to another position of the lower end of the second support portion 562. However, the present invention is not limited thereto. For example, the second resiliently-support portion 66 may have no second vertical portion 662, and the second sloping portion 666 may extend directly from the second starting point 64. According to this structure, the second starting point 64 may be located above the lower end of the second support portion 562. In other words, the upper end of the second resiliently-support portion 66 may be located adjacent to the second support portion 562 in the X-direction.

Under the separated state, the second contact point 68 is located in the second receiving portion 502 and is apart from the second support portion 562 in each of the Z-direction and the X-direction. When the second contact point 68 receives a force directed outward in the X-direction, the second resiliently-support portion 66 is resiliently deformed, and the second contact point 68 is moved toward the protection wall 564 through the second receiving portion 502. Meanwhile, an outer end of the second guide portion 669 in the X-direction is moved through the second movement-allowing portion 504 with no abutment with the protection wall 564. In other words, under the separated state, the second movement-allowing portion 504 allows the second contact point 68 to be moved in the X-direction in accordance with resilient deformation of the second resiliently-support portion 66.

Hereafter, explanation will be made about electrical connection between the first connector 12 and the second connector 15.

Referring to FIGS. 5, 9 and 14, when the second connector 15 under the separated state is moved downward, the second peripheral wall 56 is partially received in the first receiving portion 202, and the island-like portion 24 is partially received in the second receiving portion 502. As a result, each of the first contacts 40 is positioned relative to the corresponding second contact 60 in each of the X-direction and the Y-direction. Referring to FIGS. 14 and 15, when the second connector 15 is further moved downward subsequent to the aforementioned positioning, the second guide portion 669 of each of the second contacts 60 is brought into abutment with the first guide portion 469 of the corresponding first contact 40. As a result, each of the first guide portions 469 receives a force directed inward in the X-direction, and each of the second guide portions 669 receives another force directed outward in the X-direction.

When the second connector 15 is kept to be moved downward, each of the first resiliently-support portions 46 is moved inward in the X-direction, and each of the second resiliently-support portions 66 is moved outward in the X-direction. Then, each of the first contact points 48 is moved upward beyond the corresponding second contact point 68 and is brought into contact with the corresponding second resiliently-support portion 66, and each of the second contact points 68 is moved downward beyond the corresponding first contact point 48 and is brought into contact with the corresponding first resiliently-support portion 46. At that time, the connector assembly 10 is under a predetermined state where the first contact points 48 are in contact with the second resiliently-support portions 66, respectively, and the second contact points 68 are in contact with the first resiliently-support portions 46, respectively. This predetermined state of the connector assembly 10 is referred to "shallowly-mated state" where the first connector 12 and the second connector 15 are shallowly mated with each other. Under the shallowly-mated state, each of the first contacts 40 is in contact with the corresponding second contact 60 at two contact portions, namely a first contact portion 468 and a second contact portion 668, so that the first connector 12 and the second connector 15 are electrically connected with each other.

Referring to FIG. 16, when the second connector 15 is further moved downward, each of the first contact points 48 is brought into contact with the corresponding second supported portion 62, and each of the second contact points 68 is brought into contact with the corresponding first supported portion 42. At this time, the connector assembly 10 is under a deeply-mated state where the first contact points 48 are in contact with the second supported portions 62, respectively, and the second contact points 68 are in contact with the first supported portions 42, respectively. This deeply-mated state of the connector assembly 10 is also referred to "completely-mated state" where the first connector 12 and the second connector 15 are completely, or deeply, mated with each other. Under the completely-mated state, each of the first contacts 40 is kept to be in contact with the corresponding second contact 60 at two contact portions. Moreover, the first supported portion 42 and the second supported portion 62 are supported by the first support portion 242 and the second support portion 562, respectively, so as not to be moved in the X-direction (contact direction). Therefore, under the completely-mated state, the first contact point 48 and the second contact point 68 are securely in contact with the second supported portion 62 and the first supported portion 42, respectively, with sufficient contact pressure. Thus, the first connector 12 and the second connector 15 are electrically and securely connected with each other.

According to the present embodiment, the two contact portions under the deeply-mated state are widely separated from each other in the Z-direction. Therefore, even if some foreign substance enters into the first receiving portion 202 and the second receiving portion 502, the foreign substance is hardly adhered to the two contact portions at the same time, so that the electrical connection between the first connector 12 and the second connector 15 is kept stable.

Referring to FIG. 15, under the shallowly-mated state, the first contact point 48 supported by the first resiliently-support portion 46 is brought into contact with the second contact portion 668 of the second resiliently-support portion 66, and the second contact point 68 supported by the second resiliently-support portion 66 is brought into contact with the first contact portion 468 of the first resiliently-support portion 46. Meanwhile, the second contact portion 668 applies a force directed inward in the X-direction to the first contact point 48, so that the first resiliently-support portion 46 is resiliently deformed. The first contact point 48 is moved inward in the X-direction while applying another force directed outward in the X-direction to the second contact portion 668. Similarly, the first contact portion 468 applies a force directed outward in the X-direction to the second contact point 68, so that the second resiliently-support portion 66 is resiliently deformed. The second contact point 68 is moved outward in the X-direction while applying another force directed inward in the X-direction to the first contact portion 468. In other words, the first contact point 48 applies a force to the second contact portion 668 while receiving a reaction force from the second contact portion 668, and the second contact point 68 applies a force to the first contact portion 468 while receiving a reaction force from the first contact portion 468. As a result, the first contact point 48 and the second contact point 68 are securely in contact with the second resiliently-support portion 66 and the first resiliently-support portion 46, respectively, with sufficient contact pressure.

As a spring length between the second starting point 64 and the second contact portion 668 is longer, a spring force of the second contact portion 668 due to a movement thereof by a predetermined distance is smaller, but a moving distance of the second contact portion 668 is longer upon contact with the first contact point 48. Similarly, as a spring length between the first starting point 44 and the first contact portion 468 is longer, a spring force of the first contact portion 468 due to a movement thereof by a predetermined distance is smaller, but a moving distance of the first contact portion 468 is longer upon contact with the second contact point 68. Therefore, a sufficient contact pressure can be obtained regardless of the position of the first contact portion 468 in the first resiliently-support portion 46 and the position of the second contact portion 668 in the second resiliently-support portion 66.

According to the present embodiment, the most part of the first resiliently-support portion 46 can be used as the first contact portion 468, and the most part of the second resiliently-support portion 66 can be used as the second contact portion 668. In other words, the effective contact length of each of the first contact 40 and the second contact 60 can be made longer. The present embodiment provides a mechanism which enables electrical, secure connection between the first connector 12 and the second connector 15 even when the first connector 12 and the second connector 15 are shallowly mated with each other.

Referring to FIGS. 15 and 16, under each of the shallowly-mated state and the deeply-mated state, the first resiliently-support portion 46 of the first contact 40 is not in contact with any member including the first housing 20 except the first contact point 48, and the second resiliently-support portion 66 of the second contact 60 is not in contact with any member including the second housing 50 except the second contact point 68. In particular, the end of the first guide portion 469 of the first resiliently-support portion 46 is not in abutment with the separation wall 244, and the end of the second guide portion 669 of the second resiliently-support portion 66 is not in abutment with the protection wall 564. This structure not only prevents a rapid increase in contact pressure at each of the two contact portions upon contact between the first contact 40 and the second contact 60 but also prevents a plastic deformation of the first resiliently-support portion 46 and the second resiliently-support portion 66. Therefore, even after the second connector 15 is repeatedly inserted into and removed from the first connector 12, the first contact 40 and the second contact 60 are stably in contact with each other at the two contact portions.

Referring to FIGS. 7, 12 and 14, according to the present embodiment, a spring length L1A+L1B, which is a length between the first starting point 44 and the first contact point 48 on the first contact 40, is almost same as another spring length L2A+L2B, which is a length between the second starting point 64 and the second contact point 68 on the second contact 60. According to this structure, the contact pressure at the first contact point 48 is almost equal to the contact pressure at the second contact point 68, so that the electrical connection between the first connector 12 and the second connector 15 can be more stable. The first resiliently-support portion 46 and the second resiliently-support portion 66 are preferred to have shapes same as each other. Thus, the spring length L1A+L1B is preferred to be equal to the spring length L2A30 L2B. However, the shape of each of the first resiliently-support portion 46 and the second resiliently-support portion 66 may be designed depending on required electrical characteristics. For example, the spring length L1A+L1B may be between 80% and 120% (both inclusive) of the spring length L2A+L2B.

In the first contact 40 according to the present embodiment, a spring length L1A which is a length between the first starting point 44 and the first bending point 464 is shorter than another spring length L1B which is a length between the first bending point 464 and the first contact point 48. Similarly, in the second contact 60, a spring length L2A which is a length between the second starting point 64 and the second bending point 664 is shorter than another spring length L2B which is a length between the second bending point 664 and the second contact point 68. Since the first vertical portion 462 is shorter than the first sloping portion 466, the first vertical portion 462 is hard to be bent, and the first bending point 464 is hard to be moved. Similarly, since the second vertical portion 662 is shorter than the second sloping portion 666, the second vertical portion 662 is hard to be bent, and the second bending point 664 is hard to be moved. According to the present embodiment, a rapid change in contact pressure can be suppressed even when the first contact point 48 and the second contact point 68 are brought into contact with the vicinity part of the second bending point 664 and the vicinity part of the first bending point 464, respectively, so that contact reliability between the first contact point 48 and the second contact point 68 can be improved.

In particular, for the first contact 40 according to the present embodiment, a distance D1 between the first starting point 44 and the first bending point 464 in the Z-direction is not more than five times of a plate thickness of the first supported portion 42, or a size T1 of the first supported portion 42 in the X-direction. Similarly, for the second contact 60, a distance D2 between the second starting point 64 and the second bending point 664 in the Z-direction is not more than five times of another plate thickness of the second supported portion 62, or a size T2 of the second supported portion 62 in the X-direction. In other words, each of the first vertical portion 462 and the second vertical portion 662 is very short. However, the present invention is not limited thereto, but the structure of each of the first resiliently-support portion 46 and the second resiliently-support portion 66 may be designed depending on required electrical characteristics.

A plurality of the first contacts 40 (a plurality of the second contacts 60) of the present embodiment can be formed by bending a plurality of blanks punched out from a single metal plate. According to this forming method, a distance between adjacent two of the first contacts 40 (the second contacts 60) in the Y-direction can be easily changed depending on required electrical characteristics. Moreover, each of the first contact point 48 and the second contact point 68 can be shaped to have a smoothly curved surface via bending, so that each of the first contact point 48 and the second contact point 68 is not easily abraded even after the second connector 15 is repeatedly inserted into and removed from the first connector 12. In addition, an insertion force and a removal force of the second connector 15 can be reduced. However, the present invention is not limited thereto, but each of the first contacts 40 and the second contacts 60 may be a punched-out contact which is formed with no bending process.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector assembly comprising a first connector and a second connector, wherein:

the second connector is mateable with the first connector which is located below the second connector in an upper-lower direction;

the first connector comprises a first housing and a first contact;

the first housing has a first support portion and is formed with a first receiving portion and a first movement-allowing portion;

the first receiving portion receives, at least in part, the second connector when the first connector and the second connector are mated with each other;

the first support portion is located adjacent to the first receiving portion in a horizontal direction perpendicular to the upper-lower direction;

the first movement-allowing portion is located above the first support portion and is located adjacent to the first receiving portion in the horizontal direction;

the first contact has a first supported portion, a first resiliently-support portion and a first contact point;

the first supported portion extends in the upper-lower direction along a boundary between the first support portion and the first receiving portion and is supported by the first support portion not to be moved in the horizontal direction;

the first resiliently-support portion extends from the first supported portion while being apart from the first support portion in the horizontal direction;

the first contact point is supported by the first resiliently-support portion;

under a separated state where the first connector and the second connector are separated from each other, the first contact point is located in the first receiving portion and is apart from the first support portion in each of the upper-lower direction and the horizontal direction, and the first movement-allowing portion allows the first contact point to be moved in the horizontal direction in accordance with resilient deformation of the first resiliently-support portion;

the second connector comprises a second housing and a second contact;

the second housing has a second support portion and is formed with a second receiving portion and a second movement-allowing portion;

the second receiving portion receives, at least in part, the first connector when the first connector and the second connector are mated with each other;

the second support portion is located adjacent to the second receiving portion in the horizontal direction;

the second movement-allowing portion is located below the second support portion and is located adjacent to the second receiving portion in the horizontal direction;

the second contact has a second supported portion, a second resiliently-support portion and a second contact point;

the second supported portion extends in the upper-lower direction along a boundary between the second support portion and the second receiving portion and is supported by the second support portion not to be moved in the horizontal direction;

the second resiliently-support portion extends from the second supported portion while being apart from the second support portion in the horizontal direction;

the second contact point is supported by the second resiliently-support portion;

under the separated state, the second contact point is located in the second receiving portion and is apart from the second support portion in each of the upper-lower direction and the horizontal direction, and the second movement-allowing portion allows the second contact point to be moved in the horizontal direction in accordance with resilient deformation of the second resiliently-support portion;

under a completely-mated state where the first connector and the second connector are completely mated with each other, the first contact point is in contact with the second supported portion, and the second contact point is in contact with the first supported portion; and under the completely-mated state, the first resiliently-support portion is not in contact with the first housing, and the second resiliently-support portion is not in contact with the second housing;

wherein: the first contact has a first starting point; the first starting point is located at a boundary between the first supported portion and the first resiliently-support portion; the second contact has a second starting point; and the second starting point is located at a boundary between the second supported portion and the second resiliently-support portion.

2. The connector assembly as recited in claim 1, wherein a length between the first starting point and the first contact point is between 80% and 120% (both inclusive) of another length between the second starting point and the second contact point.

3. The connector assembly as recited in claim 2, wherein the first resiliently-support portion and the second resiliently-support portion have shapes same as each other.

4. The connector assembly as recited in claim 1, wherein:

the first resiliently-support portion is bent to have a first bending point;

a length between the first starting point and the first bending point is shorter than another length between the first bending point and the first contact point;

the second resiliently-support portion is bent to have a second bending point; and a length between the second starting point and the second bending point is shorter than another length between the second bending point and the second contact point.

5. The connector assembly as recited in claim 4, wherein:

a distance between the first starting point and the first bending point in the upper-lower direction is not more than five times of a size of the first supported portion in the horizontal direction; and a distance between the second starting point and the second bending point in the upper-lower direction is not more than five times of a size of the second supported portion in the horizontal direction.

6. The connector assembly as recited in claim 1, wherein:

the first resiliently-support portion has a first sloping portion;

the first sloping portion slopes and is apart from the first support portion in each of the upper-lower direction and the horizontal direction;

the first contact point is located at an end of the first sloping portion;

the second resiliently-support portion has a second sloping portion;

the second sloping portion slopes and is apart from the second support portion in each of the upper-lower direction and the horizontal direction; and the second contact point is located at an end of the second sloping portion.

7. The connector assembly as recited in claim 1, wherein one of the first connector and the second connector is a floating connector.

* * * * *